US007097517B2

(12) United States Patent
Ma

(10) Patent No.: US 7,097,517 B2
(45) Date of Patent: Aug. 29, 2006

(54) SOCKET CONNECTOR FOR INTEGRATED CIRCUIT

(75) Inventor: Hao-Yun Ma, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/993,580

(22) Filed: Nov. 19, 2004

(65) Prior Publication Data

US 2005/0118855 A1 Jun. 2, 2005

(30) Foreign Application Priority Data

Nov. 27, 2003 (TW) ..... 92220958 U

(51) Int. Cl.
*H01R 13/40* (2006.01)

(52) U.S. Cl. ..... 439/733.1; 439/331; 439/603

(58) Field of Classification Search ..... 439/733.1, 439/603, 331, 330, 342, 70, 260, 869, 83
See application file for complete search history.

(56) References Cited

U.S. PATENT DOCUMENTS 3,391,383 A * 7/1968 Antes ..... 439/331
4,195,901 A * 4/1980 Lindlau ..... 439/709
5,263,882 A * 11/1993 Peterson ..... 439/733.1
5,489,221 A * 2/1996 Fujiura et al. ..... 439/733.1
5,984,735 A * 11/1999 Daoud ..... 439/733.1
6,048,232 A * 4/2000 Chen ..... 439/733.1
6,719,573 B1 * 4/2004 Koehler et al. ..... 439/79
6,811,449 B1 * 11/2004 Yamashita ..... 439/733.1

* cited by examiner

*Primary Examiner*—Hien Vu
(74) *Attorney, Agent, or Firm*—Wei Te Chung

(57) ABSTRACT

A socket connector (1) includes an insulative housing (2) and a plurality of terminals (7) received in the housing. The housing defines a plurality of passageways (24) for accommodating the respective terminals. Each passageway forms a step (248) therein for dividing the passageway into a receiving channel (246) and an interfering channel (242). Each terminal defines a fastening portion (70) for securing the terminal in the passageway and the fastening portion forms a pair of shoulders (703) for interfering with the receiving channel. When the terminal is installed into the housing via the corresponding passageway, the shoulders are spaced from the step for forming some clearance between the shoulders and the step.

4 Claims, 5 Drawing Sheets

SOCKET CONNECTOR FOR INTEGRATED CIRCUIT

BACKGROUND OF THE INVENTION

1. Field of the Invention

The present invention relates to a socket connector for electrically connecting an integrated circuit to a printed circuit board, especially to a land grid array socket connector.

2. Description of the Prior Art

Modern computer systems increase in performance and complexity at a very rapid pace, driven by intense competition and market demands. In order to meet ever-increasing performance requirements, the area and volumetric interconnect densities of electronic board assemblies must increase accordingly. In combination with other competitive forces, this demand has driven the need for improved high-density socket technologies in computer applications, and the connector industry has responded with a variety of new alternatives to meet these needs. One of the most attractive of the new connector types is the land grid array (LGA) socket connector, which permits direct electrical connection between an LGA integrated circuit and a printed circuit board. LGA socket connectors are an evolving technology in which an interconnection between mating surfaces of an IC or other area array device and a printed circuit board is provided through a conductive terminal received in the socket connector. Connection is achieved by mechanically compressing the IC onto the socket connector.

FIGS. 4–5 disclose a conventional socket connector 90 for electrically connecting an integrated circuit (IC) package 91 to a printed circuit board (PCB) 92. The conventional socket connector 90 comprises a plurality of contact terminals 93 received in an insulative housing 94, a stiffening body 95 surrounding the housing 94, a load plate 96 pivotably assembled with one end of the stiffening body 95 and a load lever 97 pivotably attached to the other end of the stiffening body 95. The housing 94 defines a recessed area 940 for receiving the IC package 91 therein and the recessed area 940 has a bottom wall 941. The housing 94 defines a multiplicity of arrayed passageways 942 through the bottom wall 941. Each passageway 942 forms an upper receiving channel 943 and a lower interfering channel 944. The interfering channel 944 is narrower than the receiving channel 943 and a step 946 is accordingly formed. Each terminal 93 includes a fastening portion 930 defining a pair of shoulders 931 at a top portion thereof. The fastening portion 930 further defines a plurality of protrusions 932 for interfering with the interfering channel 944. When the terminal 93 is installed into the housing 94, the shoulders 931 are secured in the receiving channel 943 and abut against the step 946, and the fastening portion 930 is interferentially received in the interfering channel 944. Each terminal 93 further includes a solder portion 933 extending from and substantially perpendicular to the fastening portion 930. A solder ball 934 is attached to the solder portion 933 for mechanically connecting the connector 90 on the PCB 92 by surface mounting technology (SMT).

However, when the connector 90 is shaken by an improper exterior force, the housing moves upwardly relative to the PCB 92, and the step 946 acts on the shoulders 931 directly. As the terminal 93 is soldered on the PCB 92, the force acted on the shoulders 931 by the step 946 will break the connection between the solder ball 934 and the PCB 92, and connection between the solder ball 934 and the solder portion 933. As a result, the conventional socket connector cannot provide reliable connection between the IC package 91 and the PCB 92.

Hence, a new socket connector which overcomes the above-described disadvantages is desired.

SUMMARY OF THE INVENTION

Accordingly, a primary object of the present invention is to provide a socket connector which has reliable structure and can perform reliable electrical connection between an integrated circuit and a printed circuit board.

In order to achieve the abovementioned object, a socket connector in accordance with a preferred embodiment of the present invention comprises an insulative housing and a plurality of terminals received in the housing. The housing defines a plurality of passageways for accommodating the corresponding terminals. Each passageway forms a step therein for dividing the passageway into an upper receiving channel and a lower interfering channel. Each terminal defines a fastening portion for securing the terminal in the passageway and the fastening portion forms a pair of shoulders for interfering with the receiving channel. When the terminal is installed into the housing via the corresponding passageway, the shoulders are spaced from the step for forming some clearance between the shoulders and the step.

Other objects, advantages and novel features of the present invention will become more apparent from the following detailed description when taken in conjunction with the accompanying drawings, in which:

DESCRIPTION OF THE PREFERRED EMBODIMENT

Reference will now be made to the drawings to describe the present invention in detail.

Figure 1:
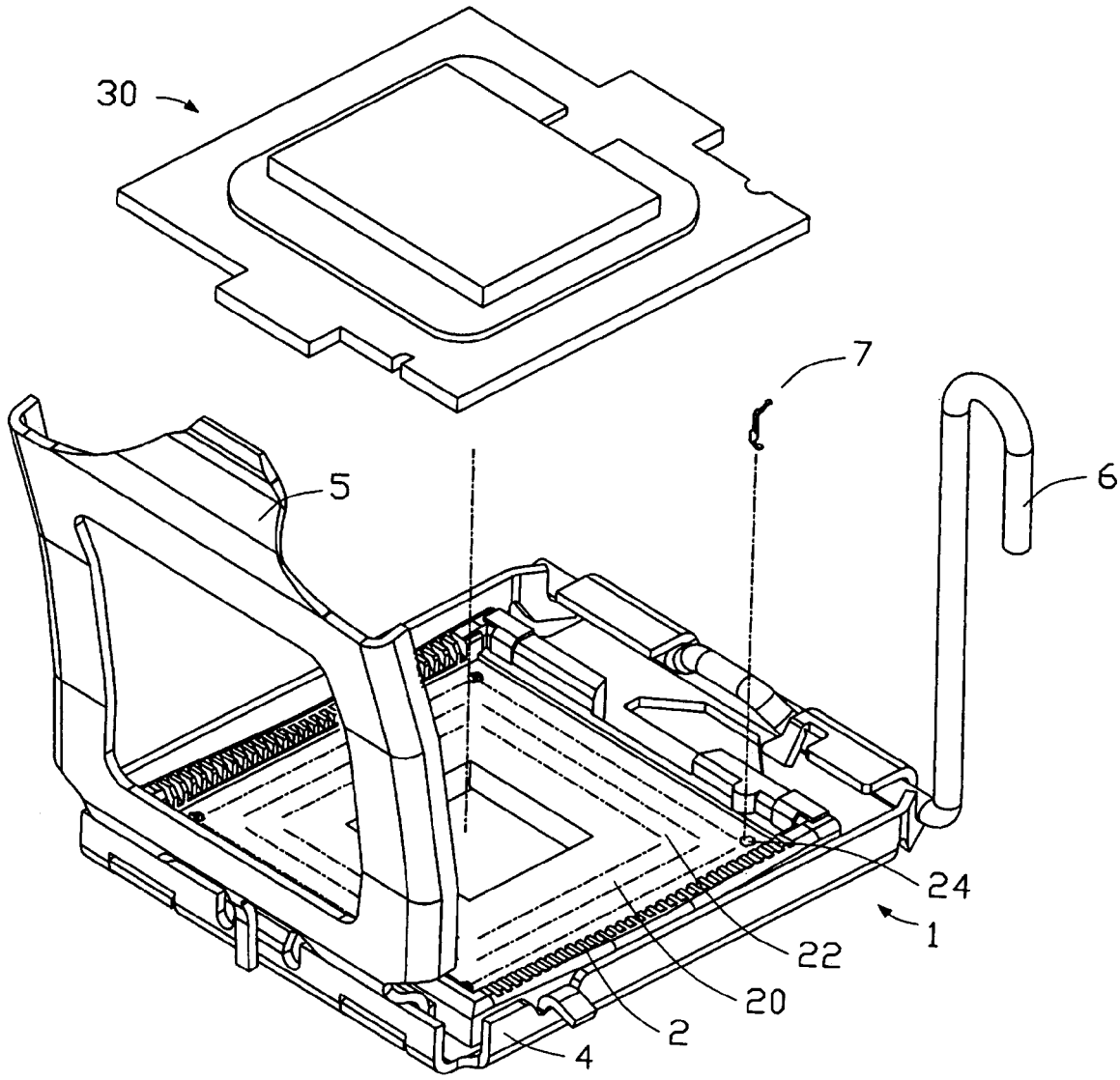
FIG. 1 is an isometric view of a socket connector in accordance with a preferred embodiment of the present invention, shown with an integrated circuit ready to be mounted onto the connector.
Figure 3:
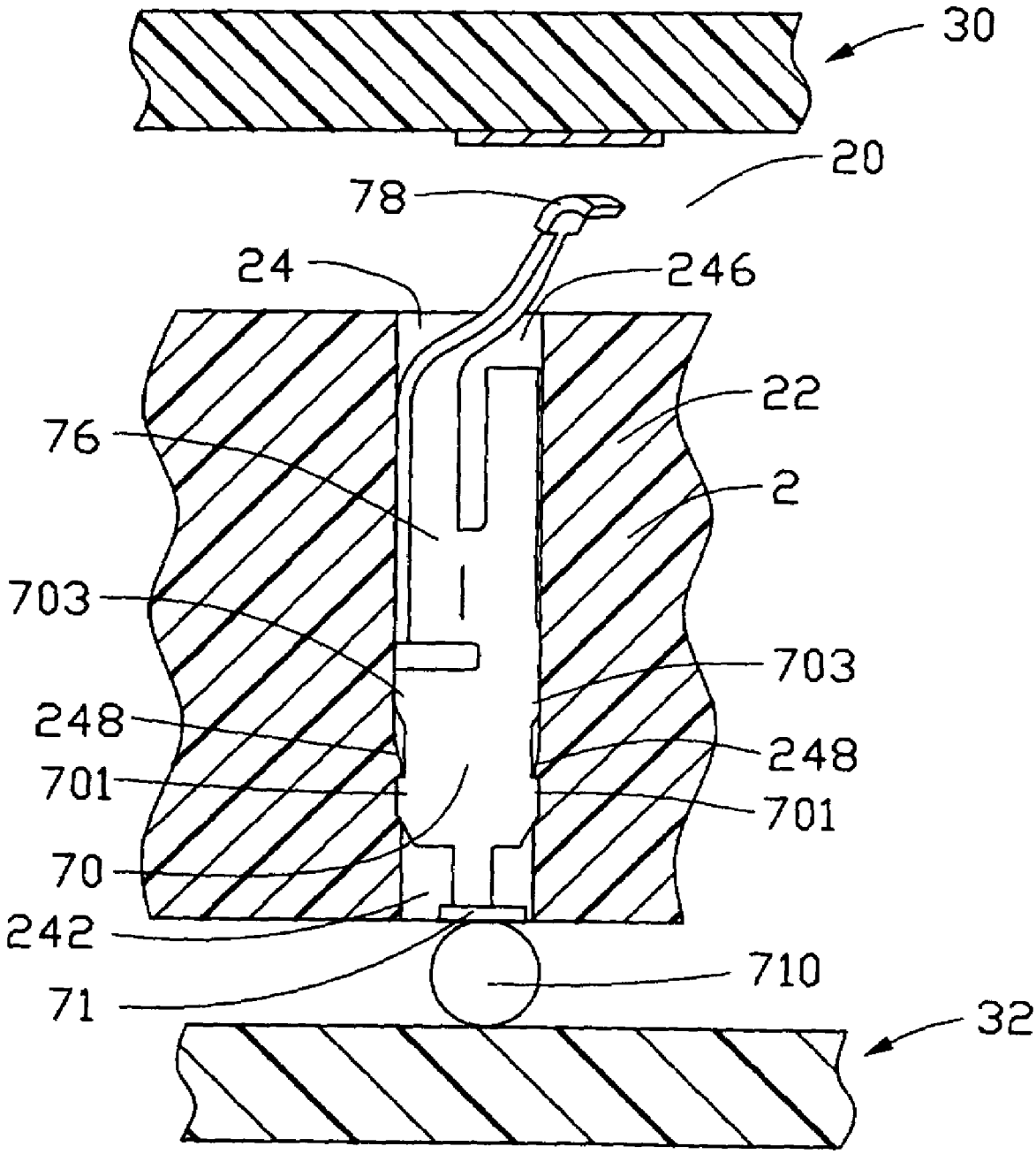
FIG. 3 is a simplified cross-section view of the socket connector of FIG. 2, shown with the integrated circuit and a printed circuit board.
Figure 4:
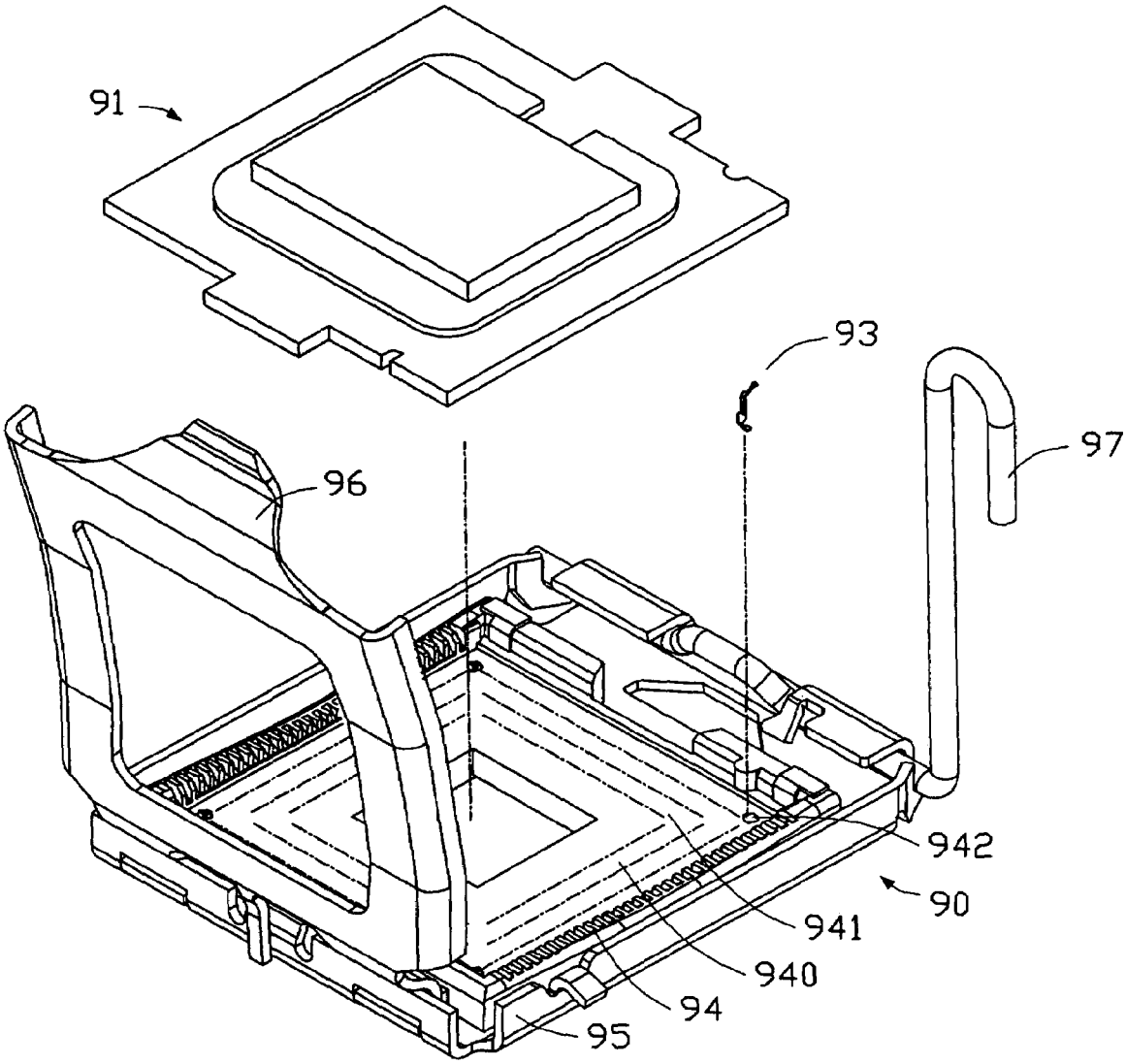
FIG. 4 (PRIOR ART)
FIG. 4 is an isometric view of a conventional socket connector, shown with an integrated circuit ready to be mounted onto the connector.
Figure 5:
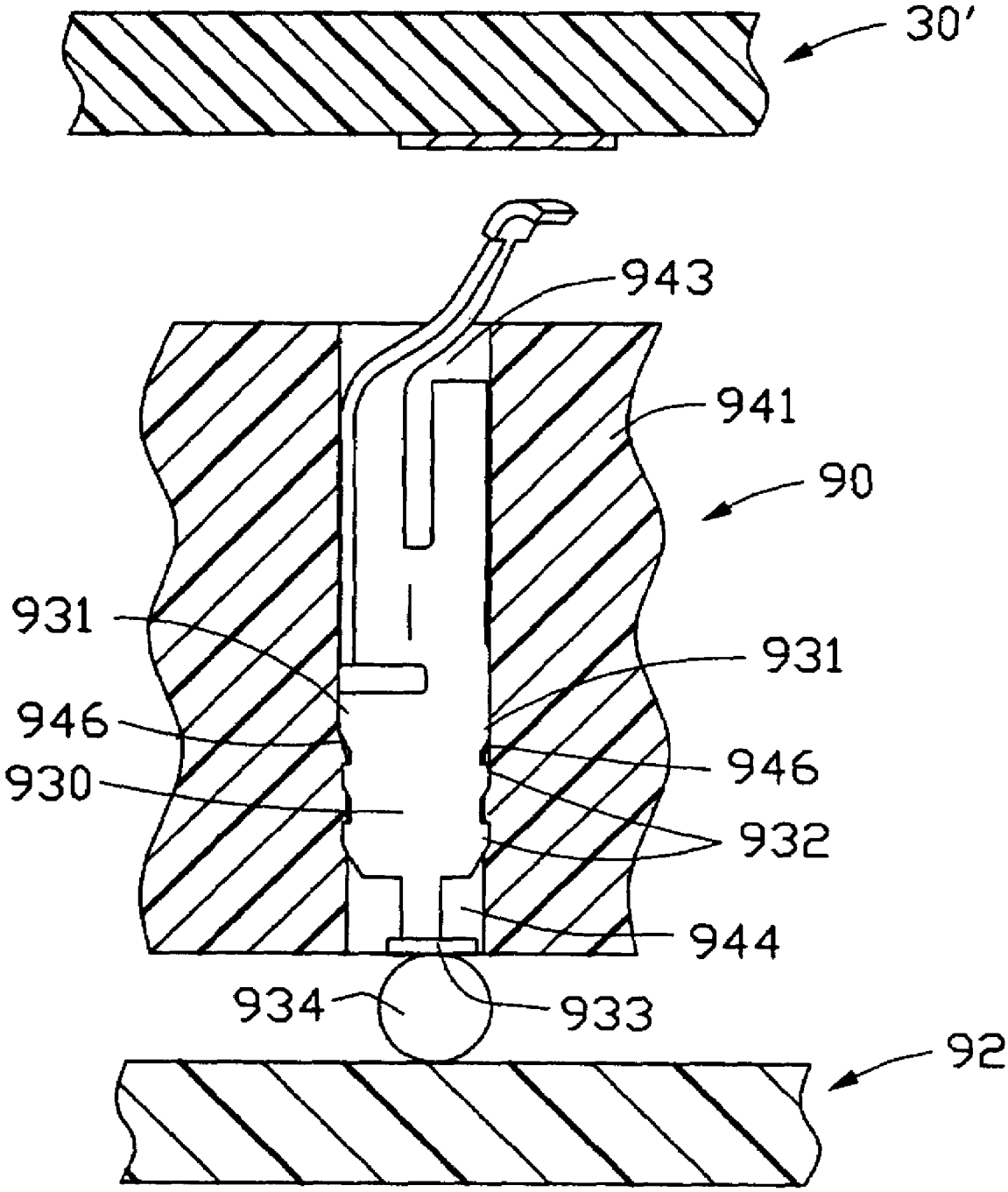
FIG. 5 (PRIOR ART)
FIG. 5 is a simplified cross-section view of the socket connector of FIG. 4, shown with the integrated circuit and a printed circuit board.

Referring to FIGS. 1 and 3, a socket connector 1 in accordance with a preferred embodiment of the present invention is adapted to electrically connect an integrated circuit (IC) 30 to a printed circuit board (PCB) 32 (shown in FIG. 3). The socket connector 1 comprises an insulative housing 2, a multiplicity of conductive terminals 7 received in the housing 2, a stiffening body 4 surrounding the housing 2, a load plate 6 pivotably assembled with one end of the stiffening body 4, and a load lever 5 pivotably attached to the other end of the stiffening body 4. The housing 2 defines a recessed area 20 for receiving the IC therein, and the recessed area 20 forms a bottom wall 22. The housing defines a plurality of passageways 24 through the bottom wall 22 for accommodating corresponding terminals 7 therein. Each passageway 24 forms a step 248 for dividing a retention portion of the passageway into an upper wider receiving channel 246 and a lower narrower interfering channel 242.

Figure 2:
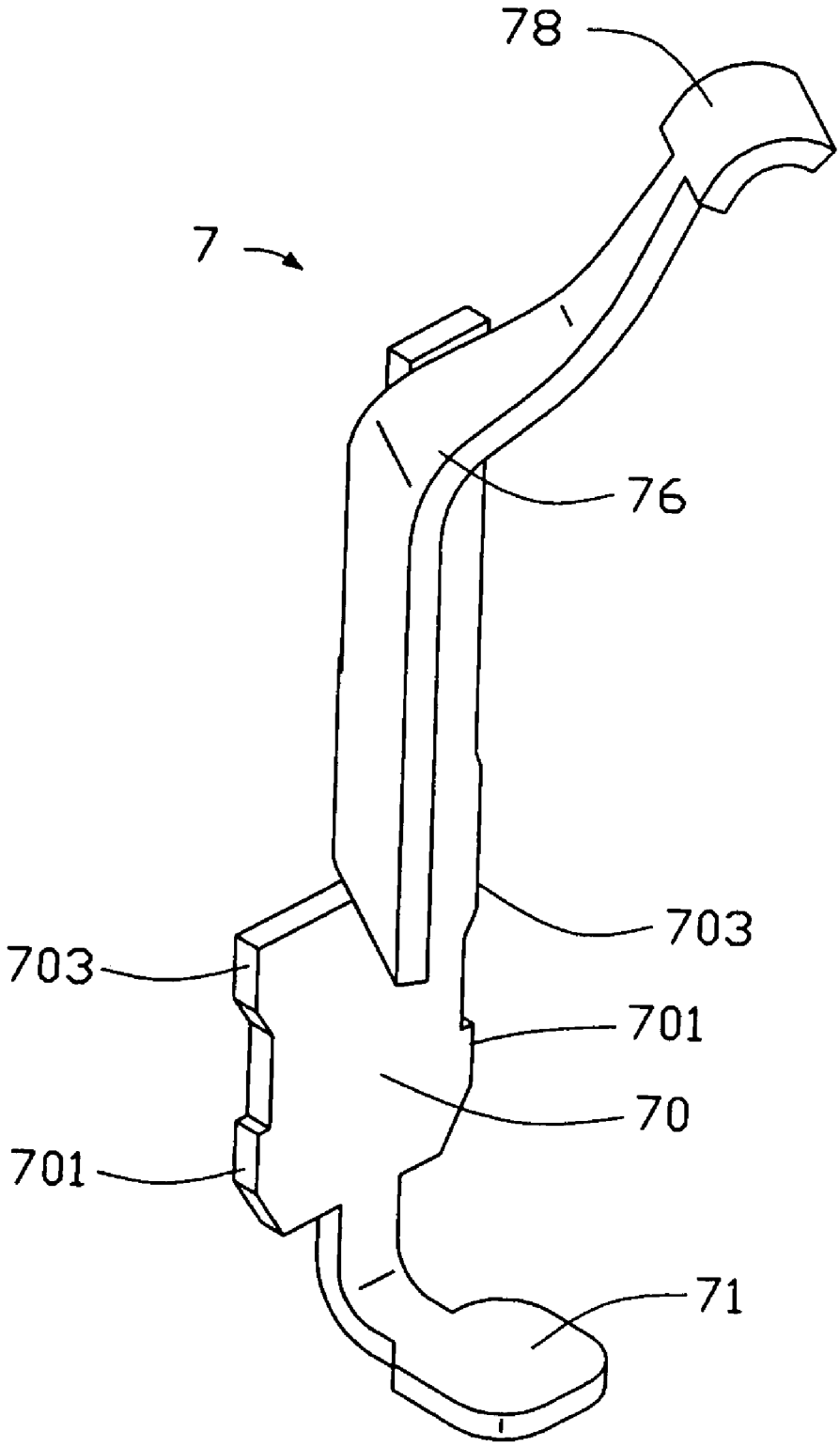
FIG. 2 is an enlarged isometric view of a conductive terminal of the socket connector.

Referring to FIGS. 2–3, the terminal 7 is formed by stamping from a conductive strip and includes a fastening portion 70, a spring arm 76 extending from the fastening portion 70, a solder portion 71 extending from and perpendicular to the fastening portion 70. The spring arm 76 forms a contacting end 78 at a distal end thereof. The fastening portion 70 further defines a plurality of protrusions 701 extending from both sides thereof and a pair of shoulders 703 extending from a top portion thereof. A solder ball 710 is attached to the solder portion 71.

Referring to FIG. 3, when the terminal 7 is installed into the housing 2, the contacting end 78 extends out of the passageway 24 for connecting to the IC 30, and the solder ball 710 is soldered on the PCB 32. The shoulders 703 interfere with the receiving channel 246 and the protrusions 703 interfere with the interfering channel 242, thereby securing the terminal 7 in the corresponding passageway 24. The shoulders 703 are spaced from the step 248 thereby forming some clearance between the step 248 and the shoulders 703.

As the clearance is formed between the shoulders 703 and the step 248, the shoulders 703 do not contact the step 248. And while the housing 2 is shaken by an improper exterior force, the clearance provides the housing 2 with a space to move, which can protect the connection between the solder ball 710 and the PCB 32 and the connection between the solder portion 71 and the solder ball 710.

While the present invention has been described with reference to specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

What is claimed is:

1. A socket connector, for electrically connecting an integrated circuit to a printed circuit board, comprising:

an insulative housing defining a plurality of passageways having a plurality of conductive terminals therein, each passageway defining a receiving channel and an interfering channel, the receiving channel being wider than the interfering channel and a step being formed from the interferring channel and in between the recieving channel and the interferring channel, each terminal defining a fastening portion having a pair of shoulders extending from a top portion of the fastening portion; wherein when the terminals are installed into the housing via the passageways, the shoulders are spaced from the steps for forming some clearance therebetween, wherein the connector further includes a stiffening body surrounding the housing, a load plate pivotably assembled with one end of the stiffening body, and a load lever pivotably attached to the other end of the stiffening body; wherein the fastening portion forms a plurality of protrusions thereon for interferential receiving the terminal in the corresponding passageway.

2. The socket connector as described in claim 1, wherein the fastening portion interferes with the interfering channel, and the shoulders interfere with the receiving channel.

3. The socket connector assembly as claimed in claim 1, wherein a lower end of each of said terminals is soldered upon a printed circuit board.

4. The socket connector assembly as claimed in claim 3, wherein said lower end is soldered to the printed circuit board via a solder ball.

* * * * *